US005900070A

United States Patent [19]

Jarvis et al.

[11] Patent Number: 5,900,070

[45] Date of Patent: May 4, 1999

[54] AUTOMATIC THERMAL INPUT SYSTEM FOR A DISHWASHER

[75] Inventors: Wilbur W. Jarvis, St. Joseph; Charles P. Deming, Stevensville; Ginger E. Patera; Ryan K. Roth, both of St. Joseph; Edward L. Thies, Niles; Kathryn A. Stady, Stevensville, all of Mich.

[73] Assignee: Whirlpool Corporation, Benton Harbor, Mich.

[21] Appl. No.: 08/997,114

[22] Filed: Dec. 23, 1997

[51] Int. Cl.[6] ..... B08B 3/02

[52] U.S. Cl. ..... 134/18; 134/25.2; 134/108; 134/104.4; 134/109

[58] Field of Search ..... 134/176, 179, 134/108, 104.4, 109, 18, 25.2

[56] References Cited

U.S. PATENT DOCUMENTS

| | | | |
|---|---|---|---|
| 3,034,518 | 5/1962 | Butsch | 134/58 |
| 4,038,103 | 7/1977 | Grunewald | 134/10 |
| 4,350,306 | 9/1982 | Dingler et al. | 241/46 |
| 4,559,959 | 12/1985 | Meyers | 134/56 |
| 4,673,441 | 6/1987 | Mayers | 134/18 |
| 5,165,433 | 11/1992 | Meyers | 134/104.4 |
| 5,172,572 | 12/1992 | Ono | 68/12.02 |
| 5,223,042 | 6/1993 | Milocco | 134/25.2 |
| 5,331,984 | 7/1994 | Isagawa | 134/57 |
| 5,429,679 | 7/1995 | Young, Jr. | 134/25.2 |
| 5,433,232 | 7/1995 | Young, Jr. | 134/111 |
| 5,449,011 | 9/1995 | Jacobus | 134/176 |
| 5,730,805 | 3/1998 | Bertsch | 134/10 |
| 5,803,100 | 9/1998 | Thies | 134/104.4 |

FOREIGN PATENT DOCUMENTS

| | | | |
|---|---|---|---|
| 93/00561 | 11/1994 | Australia | A47L 15/46 |
| 0589094A1 | 3/1994 | European Pat. Off. | A47L 15/00 |

*Primary Examiner*—Frankie L. Stinson
*Assistant Examiner*—Mialeeka C. Williams-Bibbs
*Attorney, Agent, or Firm*—Stephen D. Krefman; Joel M. Van Winkle; Robert O. Rice

[57] ABSTRACT

A thermal input system is provided for a dishwasher having an interior wash chamber receiving soiled dishes and wash liquid. A heater is disposed in a sump region of the wash chamber along with a wash pump which operates to recirculate wash liquid through out the wash chamber. A soil collection chamber receives a portion of recirculating wash liquid from the wash pump wherein soils entrained in the wash liquid are captured within the soil collection chamber. A pressure sensor senses fluid pressure within the soil collection chamber. Control means are provided for energizing the heater during a thermal hold period in response to the pressure within the soil collector exceeding a predetermined limit pressure. In particular, the control means operates to sequence the dishwasher through a predetermined period of operation but bypasses the thermal hold cycle when the pressure within the soil collector does not exceed the predetermined limit pressure.

15 Claims, 3 Drawing Sheets

AUTOMATIC THERMAL INPUT SYSTEM FOR A DISHWASHER

BACKGROUND OF THE INVENTION

1. Field of the Invention

The present invention relates to a dishwasher and more particularly, to a system for supplying heat energy for heating wash liquid in a dishwasher in response to the soil load in the dishwasher.

2. Description of Related Art

Domestic dishwashers in use today draw wash liquid from a sump at the bottom of a wash tub and spray the wash liquid within the wash tub to remove soils from dishes located on racks in the tub. It is well known that the removal of soils from the recirculating wash liquid positively impacts the wash performance of the dishwasher. Accordingly, to improve performance and efficiency, some dishwashers employ a system for separating soil out of the recirculating wash liquid wherein the soils are retained in a collection chamber.

Wash performance in a dishwasher is also related to the temperature of the dishwashing liquid. It is known that hot water is more effective for washing than cold water, particularly for oily soils which melt at higher wash liquid temperatures. Accordingly, dishwashers are commonly connected to a hot water supply such that the fill water supplied into the dishwasher has a relatively high temperature. To further improve performance, some dishwashers allow users to select a heavy wash cycle (sometimes referred to as a Pots & Pans cycle) which provides for the addition of heat energy to raise the temperature of wash liquid during portions of the wash cycle. Such thermal inputs during the dishwasher cycle typically occur during a thermal hold wherein the cycle of operation is interrupted while a heater is energized until a thermostat is satisfied or a maximum default time limit elapses.

Unfortunately, the addition of heat energy to raise the temperature of the wash liquid in a dishwasher only occurs when the user selects a heavy wash cycle, and once selected, thermal energy is added to the wash liquid regardless of actual soil load on the dishes. Accordingly, in some circumstances, heavily soiled dishes do not receive any additional thermal energy input because the operator fails to select a heavy wash cycle. This results in poor wash performance. In other circumstances, dishes which are relatively lightly soiled and do not require additional thermal input are subject to a wash cycle including additional heat energy inputs because the dishwasher operator erroneously selected a heavy wash cycle. This results in unnecessary energy usage.

Accordingly, it would be an improvement in the art if a dishwasher wash system was provided which automatically added heat energy into a dishwasher in response to the soil level of the dishes.

SUMMARY OF THE INVENTION

A thermal input system is provided for a dishwasher having an interior wash chamber receiving soiled dishes and wash liquid. A heater is disposed within a sump region of the wash chamber along with a wash pump which operates to recirculate wash liquid through the wash chamber. A soil collection chamber receives a portion of recirculating wash liquid from the wash pump wherein soils entrained in the wash liquid are captured within the soil collection chamber. A pressure sensor is provided for sensing fluid pressure within the soil S collection chamber. Control means energize the heater during a thermal hold period in response to the pressure within the soil collection chamber exceeding a predetermined limit pressure. In particular, the control means operates to sequence the dishwasher through a predetermined cycle of operation but bypasses the thermal hold period when the pressure within the soil collector does not exceed the predetermined limit pressure.

DESCRIPTION OF THE PREFERRED EMBODIMENT

The basic constructional features of the soil separator and pump system of the present invention are disclosed in U.S. Pat. No. 5,165,433, entitled "Soil Separator for a Domestic Dishwasher", herein incorporated by reference. In the '433 patent, the operation of a centrifugal soil separator and the construction of a soil separator and collector are fully explained.

Figure 1:
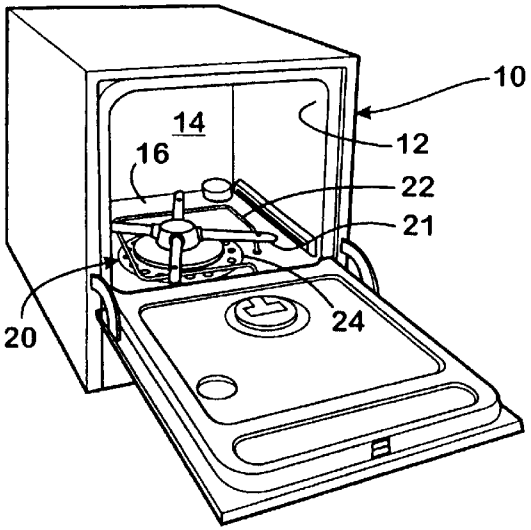
FIG. 1 is a perspective view of a dishwasher including an automatic thermal input system in accordance with the present invention.

In accordance with the invention as shown in the drawings, and particularly as shown in FIG. 1, an automatic dishwasher generally designated 10 includes an interior tub 12 forming an interior wash chamber or dishwashing space 14. The tub 12 includes a sloped bottom wall 16 which defines a lower tub region or sump 18 (FIG. 2) of the tub. A soil separator and pump assembly 20 is centrally located in the bottom wall 16 and has a lower wash arm assembly 21 extending from an upper portion thereof. Wash liquid may also be supplied to an upper spray arm (not shown). A heating element 22 is disposed within the lower portion of the dishwashing space 14 and may be operated to heat wash liquid within the dishwasher.

Figure 2:
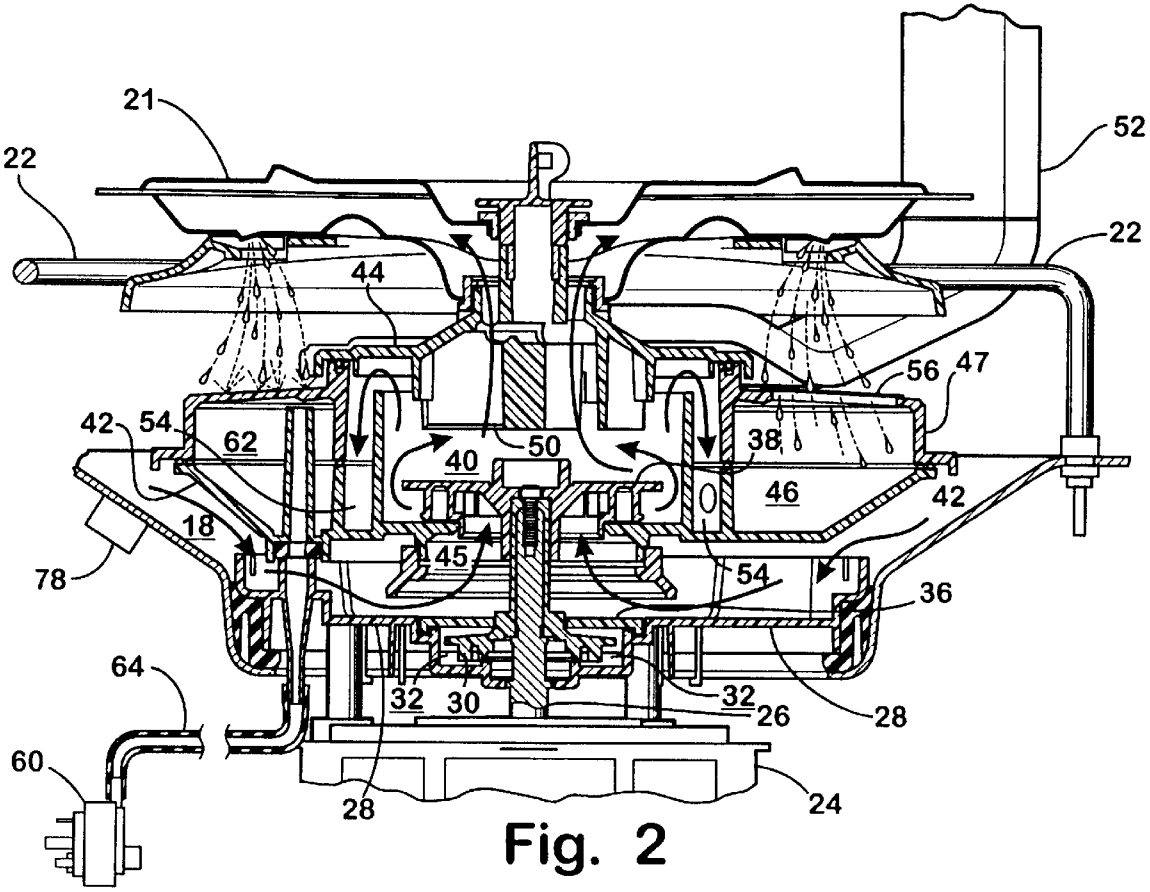
FIG. 2 is a diametric sectional view of a dishwasher pump used in the dishwashing system illustrated in FIG. 1.

Turning to FIG. 2, the soil separator and pump assembly 20 includes a motor 24 suspended below a base plate 28. The motor has an output shaft 26 which extends up through the base plate 28. A drain impeller 30 is fixed to the output shaft 28 and supported within a drain impeller chamber 32 defined by the base plate 28 and a drain cover 36. A wash impeller 38 is drivingly connected to the output shaft 26 and is supported within a pump chamber 40 defined by a pump housing 42 and pump cover 44. An annular soil collection chamber 46 is disposed about the pump chamber 40.

The motor 24 is a reversing motor which normally rotates in a clockwise direction for operating the pump in a recirculation or wash mode. During the wash mode, the wash impeller 38, driven by motor 24, draws wash liquid from the sump 18 through a pump inlet 45, provided between the pump housing 42 and the base plate 28, and pressurizes the wash liquid within the pump chamber 40. The majority of the pressurized wash liquid is directed by diffuser vanes 50 through the pump outlet and is divided between flow to the lower spray arm 21 and flow to an upper spray arm supply tube 52. A portion of wash liquid swirling within the pump chamber 40 and having a high concentration of entrained soils is directed into an annular guide channel 54 and from there into the soil collection chamber 46.

The soil collection chamber 46 is generally defined by the walls 42*a* and 42*b* of the pump housing 42 and an upper housing member 47. As wash liquid flows from the annular guide channel 54 into the soil collection chamber 46, the liquid level within the soil collection chamber 46 rises until reaching the member 47. Fine mesh filter segments 56 in the member 47 permit flow of cleansed wash liquid to exit from the soil collection chamber 46 and return to the dishwasher sump region 18. Heavy soils settle within the soil collection chamber and lighter soils are captured by the filter segments 56 such that both heavy and light soils are captured within the soil collection chamber 46.

During the wash cycle, the filter segments 56 are repeatedly backflushed. As the lower wash arm 22 rotates, pressurized wash liquid is emitted from downwardly directed backflush nozzles. Means may be provided for forming a fan-shaped spray from the flow of wash liquid through the backflush nozzles. As the lower wash arm rotates, this fan shaped spray sweeps across the filter segments 56 providing a backwashing action to keep the screen clear of soil particles which may impede the flow of cleansed wash liquid into the sump 18.

In spite of backflushing, in conditions of a heavy soil load, the filter screen segments 56 may become clogged with food soils. When this occurs, pressure within the soil collection chamber 46 increases. This pressure increase is sensed by a pressure sensor 60 which is connected to a pressure dome or chamber 62 via a pressure tap tube 64. As the pressure within the soil collection chamber 46 rises, the air within the pressure dome 62 is compressed and this increase in air pressure is sensed by the pressure sensor 60. The pressure sensor 60 may be a single-pole, double throw pressure switch which is designed to trip or actuate at a predetermined limit pressure $P_L$. The pressure sensor 60 may be mounted to any suitable structure beneath the bottom wall 16 of the dishwasher.

When the actual pressure $P_A$ in the soil collection chamber exceeds the predetermined limit pressure $P_L$, indicative of a clogged screen mesh 48, the motor 24 can be reversed from rotating in a clockwise direction to rotating in a counterclockwise direction. In this reversed direction, the drain impeller 30 operates to drain wash liquid from the dishwasher thereby clearing the soil collection chamber 46 of soils and cleaning the filter screen segments 46. Adrain pump 54 is energized to clear the screen mesh. In response to the pressure within the soil collection chamber 46 exceeding the predetermined limit pressure $P_L$ the dishwasher may be completely drained of wash liquid or just partially drained of wash liquid. If only partially drained, the amount of wash liquid drained may be controlled by time or by other means such as draining until the pressure within the soil collection chamber 46 drops below the predetermined pressure limit $P_L$.

Monitoring the pressure within the soil collection chamber 46 may also be beneficially used to control the thermal input into the dishwasher. As described above, it is well known that wash performance is improved by using warm or hot water. It is particularly desirable, therefore, to add heat to the wash liquid within the dishwasher when the dishes being washed are heavily soiled. Accordingly, the present invention provides for adjusting the dishwasher cycle and the addition of heat to the wash liquid in response to the pressure within the soil collection chamber 46 exceeding the predetermined limit pressure.

Figure 3:
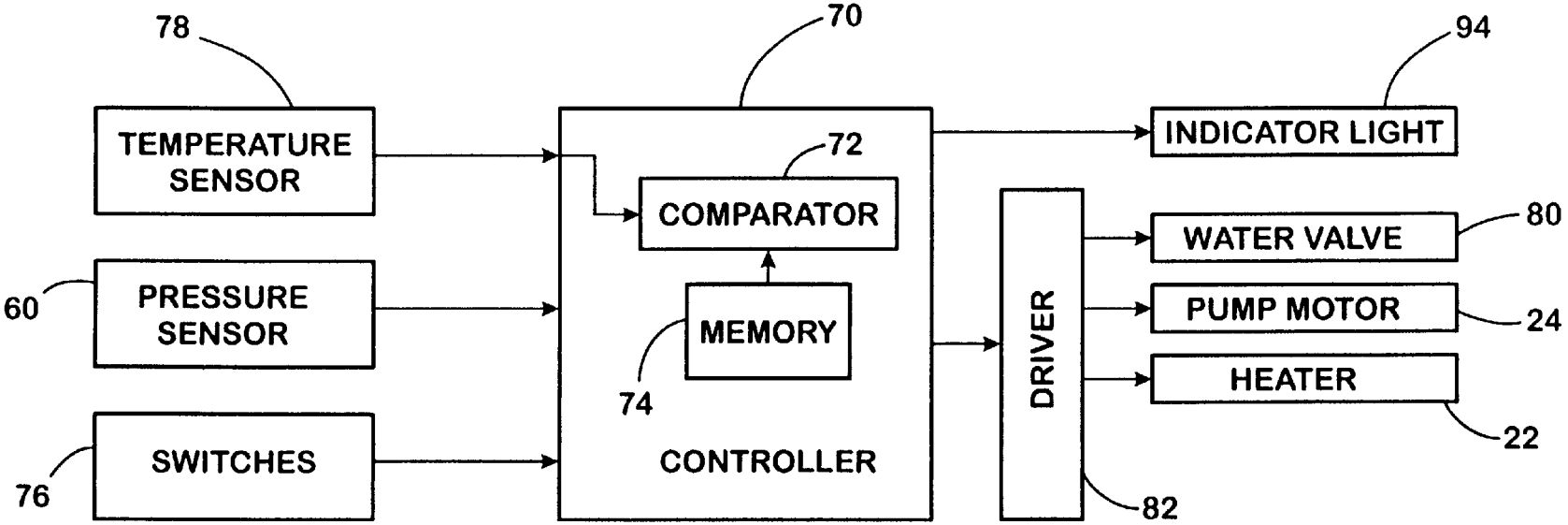
FIG. 3 is a block diagram showing an electrical arrangement of the dishwasher of FIG. 1.

FIG. 3 illustrates a block diagram of a control system for implementing a thermal hold in response to the soil level of dishes in a dishwasher. A controller 70 is provided comprising of a comparator 72 and memory means 74. The controller 70 is connected to operation switches 76 such that the dishwasher operator can input cycle selections. The controller 70 also receives input from the pressure sensor 60 and from a temperature sensor 78 which may be mounted adjacent the bottom wall 16 for sensing the temperature of wash liquid within the dishwasher (see FIG. 2). Alternatively, and as preferably contemplated, the temperature sensor may be attached to the base plate 28 and have a sensing portion protruding through a hole in the base plate for directly sensing the temperature of the wash water in the dishwasher sump 18. The temperature sensor may be a thermistor or a thermostat. A water valve 80 for supplying water into the dishwasher, the pump motor 24 and the heater 22 are connected to the controller 70 through a driver 82 such that these components can be selectively energized by the controller 70.

Figure 4:
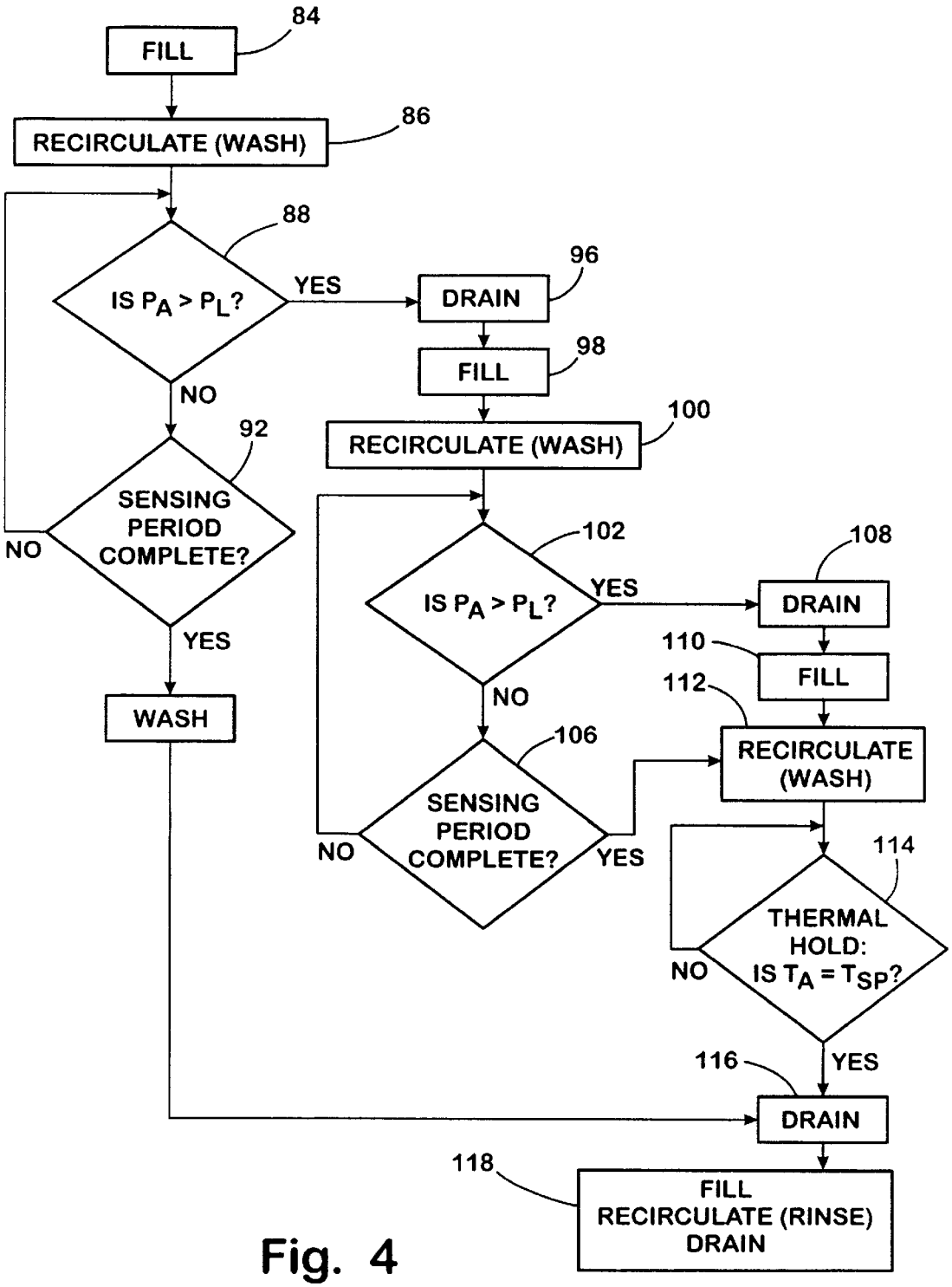
FIG. 4 is a flow chart shown the operation of a dishwasher according to the present invention.

Turning now to FIG. 4, the operation of the dishwasher can be explained. Step 84 represents a conventional fill period wherein the fill valve 80 is energized for supplying water into the dishwasher. After water is added to the dishwasher, the motor 24 is energized for recirculating wash liquid throughout the dishwasher in a wash mode as shown in step 86. During this first wash period, a first sensing period, represented by steps 88 and 92, is initiated wherein the controller 70 monitors the pressure sensor 60 to determine whether the actual pressure $P_A$ exceeds the predetermined limit pressure $P_L$. In this manner, the pressure within the soil collection chamber 46 is monitored to determine if an excessive quantity of soil is present. During this and subsequent sensing periods, an indicator light 94 (FIG. 3), such as an LED, is energized to provide feedback to the consumer that a soil sensing operation is being executed.

If during this sensing period, the actual pressure $P_A$ within the soil collection chamber 46 exceeds the predetermined pressure limit $P_L$, the dishwasher is immediately drained, step 96, followed by a second fill and the initiation of a second wash step, shown at 98 and 100, respectively. During this second wash period, a second sensing period, represented by steps 102 and 106, is initiated wherein the pressure sensor 60 is monitored to determine if the pressure in the soil collection chamber 46 exceeds the predetermined limit pressure $P_L$. If the predetermined limit pressure $P_L$ is exceeded, the dishwasher is again immediately drained, step 108, followed by a third fill and the initiation of a third wash step, shown at 110 and 112, respectively.

During the third wash period, a thermal hold step 114 is initiated. During the thermal hold, the heater 22 is energized to heat the wash liquid within the dishwasher. Assuming the temperature sensor to be a thermistor, the output $T_M$ of the temperature sensor 78 is compared by comparator 72 with a predetermined setpoint temperature $T_{SP}$, typically 130° F. to 140° F., stored in memory 74. The dishwasher remains in the thermal hold period until the wash liquid temperature equals the set point temperature $T_{SP}$ or until a default time limit is exceeded. If the temperature sensor is a thermostat, the controller 70 monitors the thermostat during the thermal hold for sensing when the wash liquid temperature is raised to the set point temperature $T_{SP}$. During the thermal hold period, the pump system 20 continues to recirculate wash liquid over the dishes.

Upon completion of the thermal hold cycle, the dishwasher is drained 116. Subsequently, the dishwasher executes a plurality of fill, recirculate (rinse) and drain steps, shown at 118, to rinse the dishes.

Accordingly, it can be understood that the above described dishwasher operation provides a thermal hold cycle only when a heavy soil load is sensed. Specifically, if during the first sensing period 88 92, the pressure with the soil collection chamber 46 never exceeds the predetermined pressure limit $P_L$, then two fill steps are avoided and the thermal hold period is bypassed. However, if during the first sensing period 88 92, the pressure in the soil collection chamber 46 exceeds the predetermined pressure limit $P_L$, then the thermal hold step is not bypassed. In this manner, heat energy is not added to the wash liquid when the dishes are only lightly soiled.

While the above description includes two sensing periods, it can be readily understood that the present invention is not limited to two sensing periods. The dishwasher cycle could be configured having more than two sensing periods or less than two sensing periods. Specifically, the present invention contemplates a dishwasher cycle having only a single pressure sensing period and wherein a thermal hold is initiated if soils are sensed during that sensing period.

It can be seen, therefore, that the present invention provides a system for bypassing the addition of thermal energy into a dishwasher when the dishes being washed are only lightly soiled. In this manner, the thermal input to the dishwasher is responsive to the soil level of the dishes such that energy is not used unnecessarily. While the present invention has been described with reference to the above described embodiments, those of skill in the Art will recognize that changes may be made thereto without departing from the scope of the invention as set forth in the appended claims.

We claim:

1. A dishwasher having an interior wash chamber receiving wash liquid and a sump region disposed at the bottom of the wash chamber, the dishwasher comprising:

a heater disposed within the interior wash chamber in the sump region;

a wash pump having an intake through which wash liquid is drawn from the sump, the wash pump further having a main outlet and a sample outlet;

a soil collection chamber receiving wash liquid from the wash pump through the sample outlet such that soils accumulate within the soil collection chamber;

a pressure sensor operatively connected with the soil collection chamber for sensing fluid pressure within the soil collection chamber; and means for energizing the heater in response to the pressure within the soil collection chamber exceeding a predetermined limit pressure.

2. The according to claim 1, further comprising:

control means for sequencing the dishwasher through a predetermined cycle of operation, the control means being connected to the pressure sensor for sensing the pressure within the soil collection chamber during predetermined periods of the dishwasher operation and further including means for energizing the heater to heat the wash liquid in response to the pressure within the soil collection chamber exceeding the predetermined limit pressure.

3. The dishwasher according to claim 1, further comprising:

a drain pump fluidly connected to the soil collection chamber; and means for operating the drain pump to drain wash liquid from the soil collection chamber in response to the pressure within the soil collection chamber exceeding a predetermined limit pressure.

4. The dishwasher according to claim 1 wherein the soil collection chamber has a filter screen wall portion for passing filtered wash liquid into the sump region.

5. The dishwasher according to claim 1, further comprising:

means for heating the wash liquid to a predetermined setpoint temperature in response to the pressure within the soil collection chamber exceeding the predetermined limit pressure.

6. The dishwasher according to claim 1, further comprising:

a pressure dome disposed within the soil collection chamber; and a pressure tap tube extending from the pressure dome to the pressure switch.

7. The dishwasher according to claim 1, further comprising:

a pressure dome disposed within the soil collection chamber; and a pressure tap tube extending from the pressure dome to the pressure switch.

8. A dishwasher having an interior wash chamber receiving wash liquid and a sump region disposed at the bottom of the wash chamber, the dishwasher comprising:

a heater disposed within the interior wash chamber in the sump region;

a wash pump having an inlet for drawing wash liquid from the sump and an outlet;

a soil collection chamber connected to the pump chamber and receiving fluid flow from the pump chamber;

a pressure sensor for sensing fluid pressure within the soil collection chamber;

means for sequencing the dishwasher through a predetermined cycle of operations including a thermal hold period for heating the wash liquid; and means for bypassing the thermal hold period if the pressure within the soil collection chamber does not exceed the predetermined limit pressure.

9. The dishwasher according to claim 8, further comprising:

a drain pump having an inlet for receiving wash liquid from the soil collection chamber and an outlet to send wash liquid to drain; and means for interrupting the cycle of operations and draining wash liquid from the dishwasher in response to the pressure within the soil collection chamber exceeding a predetermined limit pressure.

10. The dishwasher according to claim 8, further comprising:

means for heating the wash liquid to a predetermined setpoint temperature during the thermal hold period.

11. A method of operating a dishwasher, the dishwasher having pump for recirculating wash liquid within the dishwasher, a soil collection chamber for collecting soils from the recirculating wash liquid and a heater, the method comprising the following steps:

recirculating wash liquid throughout the dishwasher;

passing at least a portion of the wash liquid through the soil collection chamber such that soils are retained in the soil collection chamber;

sensing the pressure within the soil collection chamber;

adding heat to the wash liquid during a thermal hold period in response to the pressure within the soil collection chamber exceeding a predetermined limit pressure.

12. The method of operating a dishwasher according to claim 11, further comprising the steps of:

purging the soil collection chamber such that collected soils are pumped out of the soil collection chamber to drain in response to the pressure within the soil collection chamber exceeding a predetermined limit pressure.

13. The method of operating a dishwasher according to claim 11, further comprising the steps of:

bypassing the thermal hold period if the pressure within the soil collection chamber does not exceed the predetermined limit pressure.

14. The method of operating a dishwasher according to claim 11, further comprising the steps of:

heating the wash liquid to a predetermined setpoint temperature during the thermal hold period.

15. The method of operating a dishwasher according to claim 11, further comprising the steps of:

sensing the pressure within the soil collection chamber during a first sensing period;

purging the soil collection chamber such that collected soils are pumped out of the soil collection chamber to drain in response to the pressure within the soil collection chamber exceeding the predetermined limit pressure during the first sensing period;

sensing the pressure within the soil collection chamber during a second sensing period;

purging the soil collection chamber such that collected soils are pumped out of the soil collection chamber to drain in response to the pressure within the soil collection chamber exceeding the predetermined limit pressure during the second sensing period;

adding heat to the wash liquid during a thermal hold period after the second sensing period; and bypassing the second sensing period and thermal hold period if the pressure within the soil collection chamber does not exceed the predetermined limit pressure during the first sensing period.

* * * * *